US007019704B2

(12) United States Patent
Weiss

(10) Patent No.: US 7,019,704 B2
(45) Date of Patent: Mar. 28, 2006

(54) PLANAR ANTENNA WITH SUPPLEMENTAL ANTENNA CURRENT CONFIGURATION ARRANGED BETWEEN DOMINANT CURRENT PATHS

(75) Inventor: Manoja D. Weiss, Lafayette, CO (US)

(73) Assignee: Phiar Corporation, Boulder, CO (US)

( * ) Notice: Subject to any disclaimer, the term of this patent is extended or adjusted under 35 U.S.C. 154(b) by 0 days.

(21) Appl. No.: 10/335,731

(22) Filed: Jan. 2, 2003

(65) Prior Publication Data

US 2004/0130499 A1 Jul. 8, 2004

(51) Int. Cl.
*H01Q 13/10* (2006.01)

(52) U.S. Cl. ..... 343/770; 343/795; 343/700 MS

(58) Field of Classification Search ..... 343/795, 343/700 MS, 767, 770
See application file for complete search history.

(56) References Cited

U.S. PATENT DOCUMENTS 5,563,616 A * 10/1996 Dempsey et al. ..... 343/753
5,696,372 A * 12/1997 Grober et al. ..... 250/216
6,384,785 B1 * 5/2002 Kamogawa et al. . 343/700 MS
6,549,166 B1 * 4/2003 Bhattacharyya et al. .... 343/700 MS
6,624,793 B1 * 9/2003 Su et al. ..... 343/795
6,664,562 B1 * 12/2003 Weiss et al. ..... 257/21

OTHER PUBLICATIONS

Fumeaux et al., "Nanometer thin-film Ni-NiO-Ni diodes for mixing 28THz CO2-laser emissions with difference frequencies up to 176 GHz," Appl. Phys. B, 66, pp. 327-332 (1998).
Hwang et al., "Planar sandwhich antennas for submillimeter applications," Appl. Phys. Lett., 34(1), pp. 9-11 (Jan. 1979).
Lestari et al., "An Efficient Ultra-Wideband Bow-Tie Antenna," 31st European Microwave Conference, vol. 2, London, pp. 129-132 (2001).
Stutzman et al., "Antenna Theory and Design" Second Edition, John Wiley & Sons, Inc., Chapter 6.7, pp. 259-263.
Yasuoka et al., "Coupling to an "edge metal-oxide-metal" junction via an evaporated long antenna," Appl. Phys. Lett., 34, pp. 823-825 (1979).

* cited by examiner

*Primary Examiner*—Hoang V. Nguyen
(74) *Attorney, Agent, or Firm*—Michael Pritzkau; Yoriko Morita

(57) ABSTRACT

An antenna arrangement is described in which a pair of at least generally planar opposing antenna arms each support a first high frequency antenna current responsive to an input. Each arm includes a peripheral outline for confining the first high frequency current to a pair of first and second dominant paths, that are defined by the peripheral outline, in a spaced apart relationship across each of the opposing antenna arms so as to define an isolated area between the first and second paths. A configuration is located in this area of at least one of the antenna arms for producing an additional high frequency current responsive to the input. The additional high frequency current cooperates with the first high frequency antenna current to produce an overall antenna response. In one feature, the opposing antenna arms are bow arms which cooperate to define an overall bow-tie configuration as the peripheral outline.

72 Claims, 5 Drawing Sheets

PLANAR ANTENNA WITH SUPPLEMENTAL ANTENNA CURRENT CONFIGURATION ARRANGED BETWEEN DOMINANT CURRENT PATHS

BACKGROUND OF THE INVENTION

The present invention relates generally to planar antennas and, more particularly, to a planar antenna arrangement defining at least one pair of dominant paths carrying antenna currents and having a configuration disposed therebetween for producing additional antenna currents. The planar antenna of the present invention is advantageously implemented in a bow-tie configuration.

Planar antennas are used at microwave, millimeter wave, and infrared frequencies to couple energy between free space and a wire circuit. The planar configuration of these antennas enables ease of fabrication using electrically conductive layers formed on non-electrically conductive substrate materials. The antenna itself includes the electrically conductive layer sitting atop the substrate layer which, of course, exhibits a dielectric constant (defined as permittivity relative to the permittivity of free space). The high dielectric constants of familiar substrates such as, for example, silicon, act in an adverse manner by degrading the efficiency of reception, or in other words, "gain", of a signal arriving at the antenna from a direction opposite the substrate. This side is typically referred to as the "air-side" of the antenna. The gain is mathematically defined as the product of air-side directivity and radiation efficiency. Directivity represents the preferential radiation in a particular direction over all other directions. Radiation efficiency is the ratio of power radiated by the antenna to the power lost due to various mechanisms including metal losses and surface waves.

Generally, antenna currents induced from air-side radiation create high electric fields within such a high permittivity substrate, which, in turn, cause a leakage of energy into the substrate, partly in the form of surface wave modes. Further, surface waves induced by discontinuities in the substrate and traveling along the plane of the antenna, interfere with expected antenna reception. At least the aforementioned phenomena, relating to substrate properties, contribute to limited air-side gain.

The prior art has attempted to cope with limited air-side gain in a number of ways. For example, in one approach for increasing air-side gain, the conductive layer of the antenna is sandwiched between a prism and the substrate to couple energy into the antenna more efficiently, as is taught in a paper entitled "Coupling to an 'edge metal-oxide-metal' junction via an evaporated long antenna" by Y. Yasuoka et al.[1]. Unfortunately, however, at 10 μm wavelengths and below, planar antennas are themselves only several microns in length. Accordingly, attachment of such lens components is submitted to necessitate additional fabrication steps, which may well prove to be tedious and expensive.

In another approach that is described in a paper by T.-L. Hwang, et al.[2], a dielectric layer (called a superstrate) is deposited onto the air-side of the antenna with the intention of increasing antenna fields in the air-side direction. However, the reception in this case is enhanced in the plane of the antenna, and not in the air-side direction perpendicular to the antenna. For applications where the radiation is incident from the air-side direction perpendicular to the substrate, this antenna configuration of Hwang et al. will not be suitable.

Alternatively, the bottom of the substrate may be coated with a conductive layer which will reflect substrate energy leakage back towards the conductive metal layer of the antenna, as discussed in a paper by C. Fumeaux, et al. (hereinafter Fumeaux) [3] for radiation at a wavelength of 10.6 μm. At shorter wavelengths below 10 μm, however, this approach is submitted to become unreliable due to variability in the thickness of the substrate. For example, a typical silicon substrate includes a thickness of 385 μm+/−2 μm. For wavelengths on the order of 2 μm, this uncertainty in the thickness will cause unpredictable reflections by the additional conductive layer.

In still another approach, described in a paper entitled AN EFFICIENT ULTRA-WIDE BOW-TIE ANTENNA by A. A. Lestari et al. (hereinafter Lestari)[4], a bow-tie antenna is proposed which minimizes late time ringing resulting, at least in part, from internal reflections in the context of a ground penetrating radar. Such ringing is disadvantageous since it may mask radar targets. The antenna proposed by Lestari is shown in FIG. 3 of the paper, including a slot grating formed on the bow-tie configuration in attempting to reduce reflections from the open end of the bow-tie arm. Accordingly, the curved Lestari slot grating extends completely widthwise across each antenna bow arm between its diverging pair of edges. The described slot configuration is perceived by Lestari as advantageous specifically in the way that it interferes with the native, dominant bow-tie currents by causing these currents to produce radiation before reaching the open end of the bow-tie arm. This result is clearly seen in FIG. 4 of Lestari. As will be further described, the present application considers this interfering configuration as being disadvantageous.

Other approaches to the problem have encompassed the use of planar log periodic antennas. One form of planar log periodic antenna is the toothed log periodic bow-tie antenna, as described, for example, in a reference by Stutzman et al.[5]. This configuration includes slots cut into the diverging outer edges of each bow-tie antenna arm. Again, as will be further described, the present application considers this configuration as disadvantageous since native bow-tie currents are significantly altered. In the log periodic antenna and the toothed bow-tie antenna, the presence of the slots in the dominant current path cause the antenna currents to completely decay before arriving at the edges of the antenna. This avoids any resonant effects and gives rise to a broadband antenna. Insofar as applications where a resonant antenna may be preferable to keep out radiation at unwanted wavelengths, the log periodic is therefore undesirable.

The present invention provides a highly advantageous planar antenna including a grating or slot configuration which resolves the foregoing problems while providing still further advantages.

REFERENCES

[1] Yasuoka, Y., and Heiblum, M., "Coupling to an "edge metal-oxide-metal" junction via an evaporated long antenna," Appl. Phys. Lett., 34, 823–825, 1979.

[2] Tien-Lai Hwang, D. B. Rutledge, and S. E. Schwarz, "Planar sandwich antennas for submillimeter applications," Appl. Phys. Lett., 34(1), 9–11, January 1979.

[3] C. Fumeaux, W. Herrmann, F. K. Kneubuhl, H. Rthuizen, B. Lipphardt, and C. O. Weiss, "Nanometer thin-film Ni—NiO—Ni diodes for mixing 28 THz CO2-laser emissions with difference frequencies up to 176 GHz," Appl. Phys. B, 66, 327–332 (1998).

[4] A. A. Lestari, A. G. Yarovoy and L. P. Ligthart, "An Efficient Ultra-Wideband Bow-Tie Antenna," 31st European Microwave Conference, Vol. 2, London 2001, pages 129–132.

[5] Warren L. Stutzman and Gary A. Thiele, "Antenna Theory and Design," Second Edition, John Wiley & Sons, Inc., Chapter 6.7, Page 259.

SUMMARY OF THE INVENTION

As will be described in more detail hereinafter, there is disclosed herein an antenna arrangement and associated method in which a pair of at least generally planar opposing antenna arms each supports a first high frequency antenna current that is produced responsive to an input. Each of the arms includes a peripheral outline for confining the first high frequency current to a pair of first and second dominant paths, that are defined by the peripheral outline, in a spaced apart relationship across each of the opposing antenna arms so as to define an area therebetween which is isolated, at least to an approximation, from the first and second dominant paths. A configuration is located in the area between the first and second dominant paths of at least one of the antenna arms for producing an additional high frequency current responsive to the input. The additional high frequency current cooperates with the first high frequency antenna current to produce an overall antenna response. In one feature, the opposing antenna arms are bow arms which cooperate to define an overall bow-tie configuration as the peripheral outline.

In one aspect of the present invention, the opposing antenna arms independently produce a first antenna pattern including a given gain in a direction that is at least generally normal to the planar opposing antenna arms. The configuration, for producing the additional high frequency current, is formed in the area of both antenna arms in a way which produces a modified antenna pattern such that a modified gain of the modified antenna pattern in the normal direction is greater than the given gain.

In another aspect of the present invention, the opposing antenna arms independently produce a first antenna pattern having a main lobe that is centered in a direction that is at least generally normal to the planar opposing antenna arms and an arrangement of side lobes of a given energy. A configuration is formed in the area of both antenna arms such that a modified antenna pattern is produced by the configuration in cooperation with the opposing antenna arms in a way which transfers at least a portion of the given energy of the side lobe arrangement to a modified main lobe of the modified antenna pattern.

In still another aspect of the present invention, an antenna arrangement includes a pair of at least generally planar opposing antenna arms, each of which supports a first high frequency antenna current that is produced responsive to an input. The first high frequency current is confined to an arrangement of dominant paths that is defined by each of the opposing antenna arms so as to produce a first antenna pattern such that the arrangement of dominant paths defines, between individual ones of the dominant paths, an area of the substrate which, at least to an approximation, does not support the first high frequency current. A configuration is positioned in the non-current supporting area of at least one of the antenna arms for modifying the first antenna pattern in a way which produces a modified antenna pattern, responsive to the input.

In yet another aspect of the present invention, an antenna arrangement includes at least one substrate having a planar configuration and a substrate thickness defined between a pair of opposing major surfaces thereof. An electrically conductive ground plane layer is supported on a first one of the major surfaces of the substrate, while a dielectric layer is directly supported by the electrically conductive ground plane layer opposite the substrate. A patterned electrically conductive layer is supported directly by the dielectric layer, opposite the electrically conductive ground plane layer, for providing an antenna pattern. In one feature, the substrate thickness is characterized by a substrate thickness tolerance and the dielectric layer includes a dielectric layer thickness that is characterized by a dielectric layer thickness tolerance such that the dielectric layer thickness tolerance is greater than the substrate thickness tolerance.

BRIEF DESCRIPTION OF THE DRAWINGS

The present invention may be understood by reference to the following detailed description taken in conjunction with the drawings briefly described below.

DETAILED DESCRIPTION OF THE INVENTION

Figure 1:
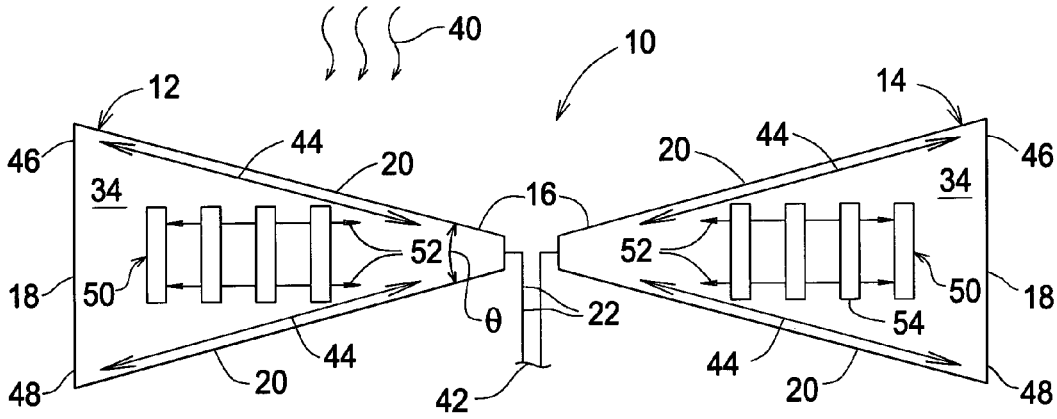
FIG. 1 is a diagrammatic plan view of a planar antenna configuration of the present invention, shown here to illustrate details of its highly advantageous structure.

Turning now to the figures, wherein like reference numbers are used to refer to like components, attention is immediately directed to FIG. 1 which illustrates one implementation of a planar antenna produced in accordance with the present invention and generally indicated by the reference numeral 10. It is noted that the various figures are not to scale for purposes of enhancing the reader's understanding. Moreover, descriptive terminology such as upper, lower, vertical and horizontal is in no way intended as limiting with respect to device orientation or operation as is used only for the purpose of providing a detailed understanding.

In the present example, planar antenna 10 includes a peripheral outline that is in the form of a bow-tie which is defined by an opposing pair of first and second bow arms 12 and 14, respectively. Each bow arm includes an innermost apex end 16 and an outermost edge 18. A pair of outwardly diverging edges 20 extend between apex end 16 and outermost edge 18 of each bow arm. Apex ends 16 of the bow arms may be externally interfaced in any number of suitable ways, as will be further described at an appropriate point below. In the present example, however, apex ends 16 of antenna 10 are electrically interfaced with a pair electrical signal leads 22 (only partially shown). Dimensional considerations will be taken up at appropriate points below.

Figure 2A:
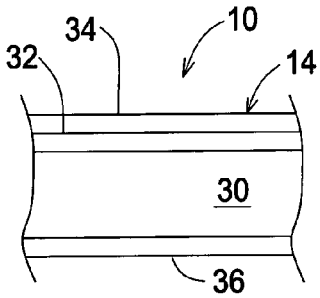
FIG. 2A is a diagrammatic edge view of one of the antenna arms of the antenna shown in FIG. 1, illustrating details of its structure.

Turning now to FIG. 2A, in conjunction with FIG. 1, the former figure provides a partial edge view of bow arm 14, which includes the same structure as bow arm 12. A dielectric substrate 30 may be formed from any suitable material including, but not limited to silicon, quartz, gallium arsenide, and alumina. The substrate may be shaped, for example, by reactive ion etching. Substrate 30 supports a layer of dielectric material 32 such as, for example, silicon dioxide which may be formed, for instance, by oxidizing an outermost portion of silicon forming the substrate itself. A layer of electrically conductive material 34 is supported on dielectric layer 32. Dielectric layer 32 may have any suitable thickness such as, for example, a quarter of a wavelength with which the antenna is intended to be compatible, while the electrically conductive layer may have any suitable thickness such as, for example, at least four skin depths. As is known in the art, the skin depth of a metal is a measure of the penetration of the electric field inside the metal, and is a function of wavelength. For instance, the skin depth is about 20 nm for radiation of wavelength $\lambda$=1.55 μm. Electrically conductive layer 34 may be at least generally coextensive with substrate 30 in its major plane. Electrical leads 22 are interfaced with electrically conductive layer 34 for each bow arm in any suitable manner such as, for example, by photo and/or electron beam lithography. Opposite electrically conductive layer 34, substrate 30 may support an electrically conductive ground plane layer 36. It should be appreciated that ground plane layer 36 is optional, as will be described in further detail at an appropriate point below. When ground plane layer 36 is used, it may be formed in any suitable manner such as, for example, by evaporation or sputtering of a metal. One suitable thickness for the ground plane layer includes, for example, at least four skin depths.

Referring again to FIG. 1, electrically conductive layer 34 supports a high frequency surface current, which is the result of one or both of an input electromagnetic radiation 40 that is incident on the bow arms and any suitable electrical signal 42 that may be provided as an input on electrical signal leads 22. While these currents may be referred to in this description, as well as in the appended claims, using the terms high frequency currents or "surface currents", it is to be understood that the current being described is present at or proximate to the surface of electrically conductive layer 34 of each bow arm and is additionally induced up to some depth, from a practical standpoint, into the conductive layer of the bow arm carrying the current. It is noted that additional details relating to surface currents in antennas are described in copending U.S. patent application Ser. No. 10/265,935, entitled DEVICE INTEGRATED ANTENNA FOR USE IN RESONANT AND NON-RESONANT MODES AND METHOD (hereinafter '935 application), which is incorporated herein by reference. Generally, such surface current decays rapidly with increasing depth into a conducting body (i.e., layer 34) so as to exhibit significantly higher magnitudes in the immediate vicinity of the surface.

Still considering details with regard to the subject surface currents, because the wavelength characterizing the surface currents, at the contemplated wavelengths, is comparable to the geometry of the bow-tie antenna, another important property of the antenna arises. Specifically, the surface currents are not only confined depth-wise in the bow arms, but are also confined in a lateral sense on the major surface of the bow arms at which they are induced. The surface currents are confined in the plane of FIG. 1 to particular paths within the antenna arrangement which are defined, at least in part, by the peripheral outline or configuration of the bow-tie antenna itself. These paths are referred to herein as dominant paths or may be referred to, in the instance of a resonant antenna, as resonant paths. In the case of a bow-tie antenna, a pair of native, dominant paths is present. In FIG. 1, the dominant paths are illustrated using double-headed arrows indicated by the reference number 44. One of the dominant paths is defined along each side margin or diverging edge 20 of each of the bow arms. Each of the dominant paths, along opposing side margins of the antenna, can be thought of as passing through the intersection of the bow arms or through a device that is positioned between the confronting portions of the bow arms at their innermost ends, as described in detail in the above incorporated '935 application.

In a resonant configuration, the peripheral outline of the antenna arrangement serves to define further characteristics of dominant paths 44. In particular, outermost ends 18 of the bow arms serve to define reflector configurations which terminate the dominant paths. The reflector configuration of each outermost end is made up of first and second reflector segments 46 and 48. These reflector segments may comprise terminating edge segments of electrically conductive layer 34 as portions of outermost edges 18. In this regard, it should be appreciated that the antenna configuration of FIG. 1 is illustrative of a resonant antenna configuration in which the surface currents oscillate or resonate along the dominant paths. Resonant antenna configurations are advantageous, for example, in order to filter out radiation at unwanted wavelengths and when an active device is present at the intersection of the bow arms, as described in the above incorporated '935 application, to enhance interaction between the surface currents and the active device at the intersection of the bow arms.

In the present example, each bow arm includes an elongation axis about which the reflector segments are symmetrically arranged, however, this is not a requirement so long as the resonance functionality of the dominant paths is not overly suppressed. In terms of design concerns, it is recognized that the width of the dominant paths is influenced by a combination of factors at least including material properties of the bow arms and the angle of flare used in the bow arm (indicated as θ in FIG. 1). Typical bow-tie antenna patterns that arise from the native dominant path currents supported on a dielectric substrate exhibit the limited air-side gain limitation described above and are considered in further detail below.

Having described the native dominant paths of the exemplary bow-tie configuration, still referring to FIG. 1, it is recognized by the present invention that an area on each antenna arm, residing between its diverging edges 20, is essentially unused insofar as supporting surface currents which provide for antenna gain or which significantly influence the bow-tie antenna pattern. Accordingly, the present invention introduces a highly advantageous, supplemental configuration, located in the area between dominant paths of at least one of the antenna arms for producing an additional high frequency current responsive to an input in the form of either an incident electromagnetic radiation or an electrical drive signal provided on leads 22. For purposes of symmetry in the resultant antenna pattern, the supplemental configuration may be provided on both bow arms.

In the present example, a highly advantageous grating or slot configuration 50 is provided on each of bow arms 12 and 14 for producing supplemental surface currents 52, which are diagrammatically indicated using dashed double headed arrows. These latter surface currents are produced by a plurality of spaced apart elongated slots, one of which is indicated by the reference number 54, making up configuration 50. In the present example, each slot 54 includes a rectangular configuration. It is to be understood, however, that this is not a requirement and that any suitable peripheral outline may be used for these slots. Each slot includes an elongation length to be determined, in one manner, as described below and a width that is at least sufficient to maintain a power flow along the slot grating. These dimensions, particularly the elongation length, are established so as to avoid significant interference with surface currents that flow in dominant paths 44 such that supplemental surface currents 52 provide additional surface currents, above and beyond the native surface currents of any particular antenna configuration such as the bow-tie configuration of the present example. In this way, a resultant antenna pattern, yet to be described, is a modified form of a "native" antenna pattern such as a bow-tie pattern and some additional pattern that is produced by configuration 50, as will be further described below.

Figure 2C:
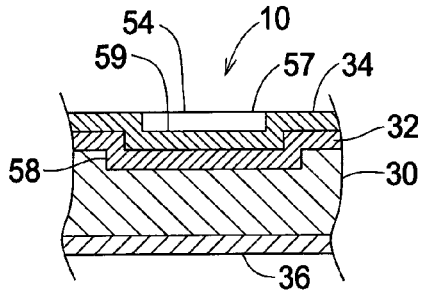
FIG. 2C is a diagrammatic view, in cross-section, illustrating another manner of forming slots as part of a grating for use in the antenna of FIG. 1.
Figure 2B:
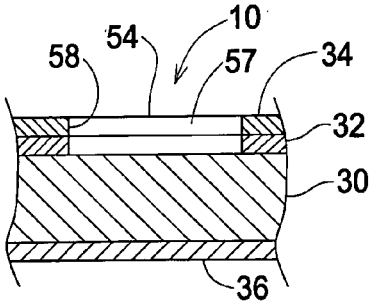
FIG. 2B is a diagrammatic view, in cross-section, illustrating one manner of forming slots as part of a grating for use in the antenna of FIG. 1.

Referring to FIG. 2B, still considering the configuration of slots 54, these slots, like any slot used in the configurations contemplated herein, may be formed, for example, as a void in electrically conductive layer 34. The present figure is a cross-sectional view taken through one of slots 54 perpendicular to the elongated length of the slot (i.e., across the width of the slot and looking toward an end peripheral sidewall 57 of the slot) and showing its widthwise edges 58 cooperating to define an overall, closed peripheral sidewall configuration. The slot is formed as an aperture by removing layers 32 and 34 in the region of the slot. It is noted, however, that removal of layer 32 is not required. Various processes may be directed to the purpose of removing electrically conductive layer 34 such as, for example, photolithography or electron beam lithography.

Turning to FIG. 2C, another alternative is illustrated in forming the grating configuration of the present invention. Specifically, layer 34 may comprise a uniform coating that is applied over inset or step-down regions that are formed in substrate 30. FIG. 2C illustrates an inset region 59 which defines the closed peripheral sidewall configuration of the slot. In the present example, electrically conductive layer 34 is conformally supported. That is, in the example shown in FIG. 2C, layer 34 conforms in shape to the inset region 59 but forms a continuous layer. One suitable technique for forming the inset or step-down substrate regions comprises photolithographic etching, while the electrically conductive layer may be applied, for example, by various deposition techniques that are know in the art such as sputtering and evaporation. It is noted that suitable implementations may be provided with or without coating the peripheral sidewalls which serve to define the inset regions; the slot serves its intended purpose in either configuration.

Figure 2D:
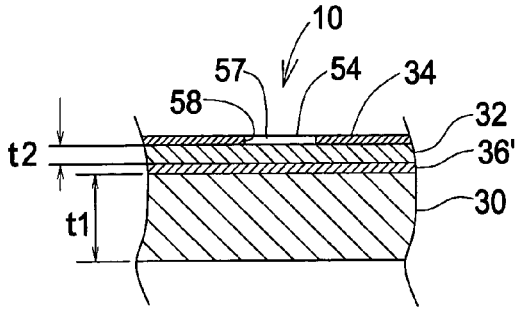
FIG. 2D is a diagrammatic view, in cross-section, illustrating still another manner of forming slots as part of a grating for use in the antenna of FIG. 1 including a ground plane layer that is located on the device or upper side of the substrate.

Attention is now directed to FIG. 2D, which illustrates another alternative embodiment of antenna 10. This figure is a cross-sectional view again taken through one of slots 54, perpendicular to the elongated length of the slot (i.e., across the width of the slot and looking toward an end peripheral sidewall 57 of the slot) and showing its widthwise edges 58 cooperating to define an overall, closed peripheral sidewall configuration. The slot is formed in the present example by removing layer 34 in the region of the slot. The primary difference between this embodiment and previous embodiments resides, however, in the placement of the ground plane, which is indicated by the reference number 36'. Specifically, ground plane layer 36' is on the same side of substrate 30 as dielectric layer 32 and electrically conductive layer 34. These latter two layers are supported by ground plane layer 36'.

The embodiment of FIG. 2D is considered to be particularly advantageous since this positioning of the ground plane layer serves to virtually resolve any concern as to variability of substrate thickness which can influence antenna response arising from unpredictable reflections, as discussed above with regard to the Fumeaux reference. In this regard, substrate 30 includes a thickness, t1, characterized by a substrate thickness tolerance and dielectric layer 32 includes a dielectric layer thickness, t2 that is characterized by a dielectric layer thickness tolerance such that the dielectric layer thickness tolerance is greater than the substrate thickness tolerance. Ground plane layer 36' can be formed, for example, by evaporation. Dielectric layer 32 may be grown on top of ground plane layer 36' to provide a highly controllable and consistent thickness tolerance, for example, by sputtering. Electrically conductive antenna layer 34 may be formed, for example, as described above.

Still considering the FIG. 2D embodiment with regard to Fumeaux, it is recognized herein that the Fumeaux configuration is of still further concern since typical substrates have a bottom side, opposite the device side, which is relatively rough, compared to the device side. This occurs because the device side of a substrate is typically polished while the bottom side is unpolished. Accordingly, it is submitted that unpredictable reflections seen in Fumeaux will be of even greater concern using a substrate with an unpolished or rough bottom surface. One might suggest a solution as simply using a substrate having both the device and bottom sides polished. Unfortunately, the cost of bottom polished substrates is significantly higher than those having only the device side polished. The present invention, in contrast, completely resolves this concern by application of the ground plane to the device side of the substrate.

Attention is now directed to a detailed design simulation and a design protocol used in implementing the present simulation. For resonant bow-tie antennas, which are generally on the order of or shorter than a few wavelengths long, the reception pattern is a function of its length. Depending on the length, the reception pattern has a maximum or a minimum in the air-side direction. Although the present invention improves the surface normal reception for both cases, the example shown here is directed to illustrating improvement in the instance of a maximum, since the goal is to have maximal air-side gain. The simulation was performed using a commercially available electromagnetic simulation package.

Figure 3:
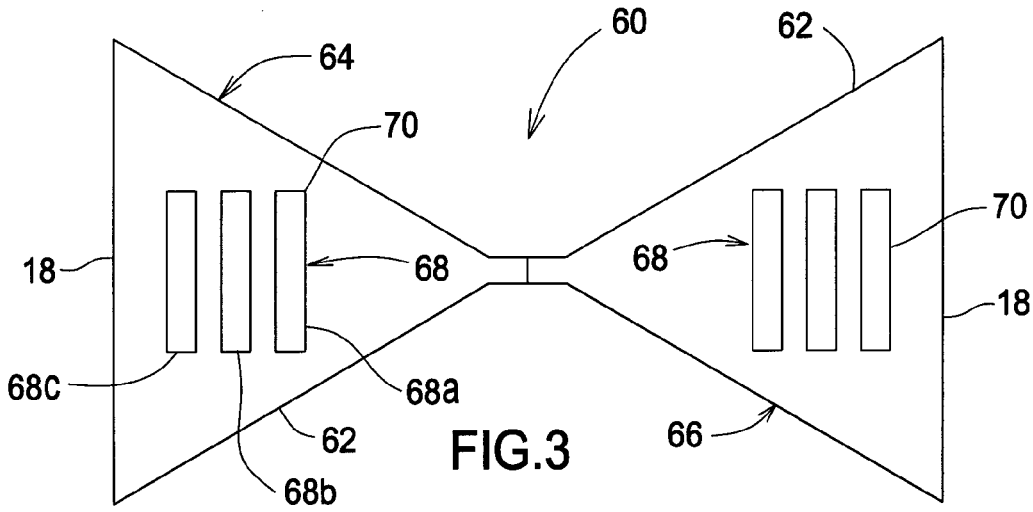
FIG. 3 is a diagrammatic plan view of a simulation antenna, designed in accordance with the present invention and used in producing simulation results that confirm a range of advantages that accompany the use of the teachings of the present invention.

Referring to FIG. 3, a simulation bow-tie antenna configuration is illustrated, generally indicated by the reference number 60, having a peripheral bow-tie outline 62. Opposing bow arms 64 and 66 are shown. Antenna 60 of FIG. 3 is selected as having peripheral outline 62 of 3 μm, which is equivalent to about 3 effective wavelengths long at the simulation wavelength. A supplemental antenna current configuration 68, of the present invention, is illustrated on each of the bow arms. In the present example, each supplemental antenna current configuration is made of a series of spaced apart, rectangular slots, several of which are indicated by the reference number 70.

Figure 4:
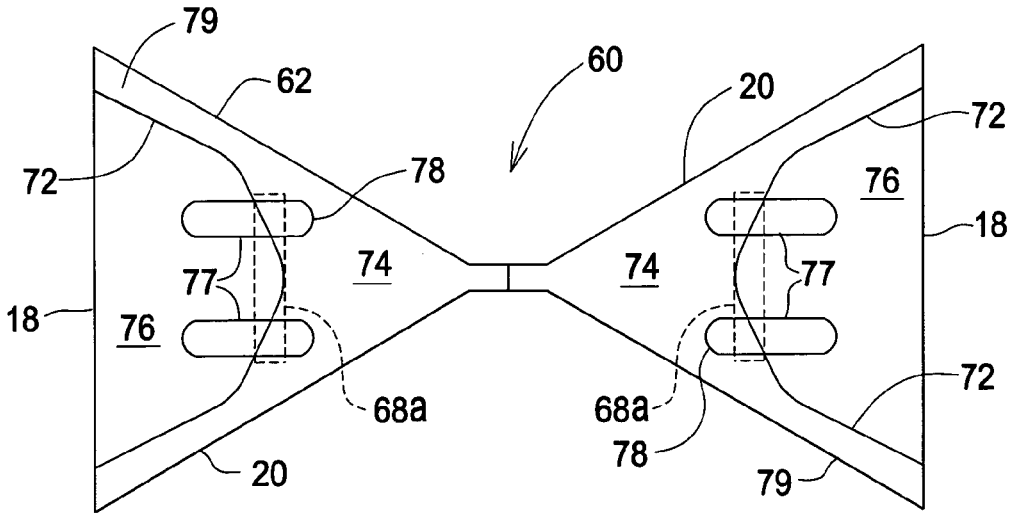
FIG. 4 is a diagrammatic plan view showing current distribution on the simulation antenna of FIG. 3 to demonstrate certain aspects of a design protocol for use in designing an antenna in accordance with the present invention.

Referring to FIG. 4, simulation antenna 60 is diagrammatically shown, but without supplemental antenna current configuration 68, only partially shown, for purposes of illustrative clarity. In a first portion of the simulation design protocol, surface currents are identified in a conventional bow-tie configuration, having peripheral outline 62, using a two-dimensional electromagnetic simulation to show the current distribution on an unmodified bow-tie antenna. Original results were obtained in a grayscale format, showing relative values of surface currents across each bow arm. Although the grayscale results have not been presented due to patent illustration constraints, however, a border 72, in the form of a line, has been shown on each bow arm to represent, at least to an approximation, the border between regions which do not support a native bow-tie surface current and regions which support a native bow-tie surface current. In the present example, border 72 divides a current-supporting area 74 of each bow arm, including the apex of the bow arm having a maximum current value, from a current-free area 76 in which the surface current has decayed to about $1/100^{th}$ or less than the maximum current in current-supporting area 74.

Referring to FIGS. 3 and 4, it should be appreciated that the overall antenna pattern to which any supplemental surface current structure contributes, in order to be implemented in a way which is consistent with the teachings herein, is dependent on positioning of the supplemental surface current structure as well as its dimensions. Accordingly, supplemental surface current configuration 68 is positioned and dimensioned in view of border 72 so as to be close enough to the apex of each bow arm to couple into the native, high currents at the apex of the bow-tie, without significantly reducing these native bow-tie currents proximate to each bow arm apex. That is, coupling with the conventional bow-tie currents is accomplished by positioning innermost slot 68*a* (shown in phantom in FIG. 4) so as to at least slightly overlap border 72 in order to "inject" an additional surface current 77 into the surface current that is already present in the native bow-tie configuration. Additional surface current 77 is diagrammatically illustrated using oval-shaped areas which were seen to support the additional surface currents, at least to a reasonable approximation, in the aforementioned grayscale simulation results. It is noted that FIG. 1 illustrates these additional currents as supplemental surface currents 52. Accordingly, such positioning injects or couples additional surface current 77 into the overall antenna structure since an inward end 78 of each additional current oval partially overlaps native current-supporting region 74.

The width and spacing of each elongated slot 68*a*–68*c* was chosen to be 100 nm for 1.55 μm radiation while each elongated slot includes a length of approximately 500 nm. The metallic bow-tie pattern of layer 34 (see FIG. 1) is fabricated on top of a 0.75 μm-thick silicon dioxide ($SiO_2$) layer, which sits on top of a silicon wafer. For this dielectric arrangement, the effective wavelength is about 1.0 μm, and, therefore, 100 nm is about 1/10th of the effective wavelength. The lengths of the slots are chosen so as not to interfere with the conventional bow-tie currents running along edges 20 of the bow arms. That is, the slot configuration is isolated from the dominant paths, being arranged therebetween. In this regard, referring to FIG. 4, region 74 is seen to include the dominant paths in narrow regions 79 that are proximate to diverging edges 20 of each bow arm. The configuration of current border 72, therefore, is readily used in arranging the slot configuration so as to avoid interfering with the dominant paths. It is worthwhile to note that antenna 60 is used in a resonant configuration, since dominant path regions 79 extend to outer edge 18 of each bow arm thereby reflectively interacting. Moreover, it is also recognized that the addition of the supplemental surface current configuration results in no discernable change in the widths of dominant path regions 79 along diverging edges 20, thereby confirming the value of the present design protocol. Specific details with regard to the advantages provided by the supplemental surface current configuration of the present invention will be provided immediately hereinafter.

Figure 6:
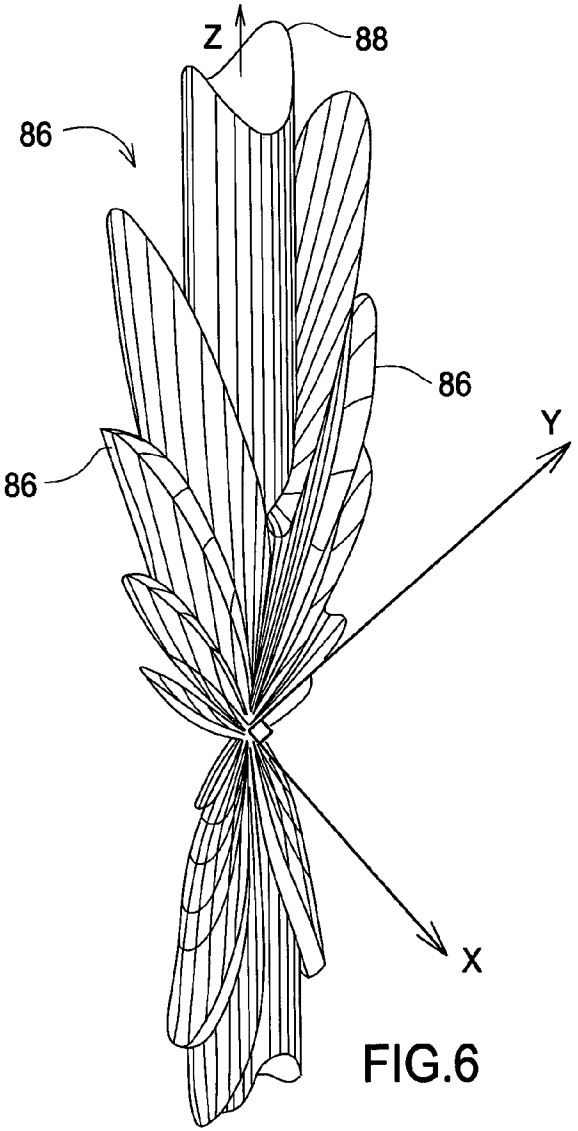
FIG. 6 is a perspective view of a three-dimensional antenna pattern representing an overall antenna pattern, produced in accordance with the present invention, comprising the first antenna pattern of FIG. 5 and a supplemental antenna pattern that is provided by the supplemental antenna current configuration of the present invention.
Figure 5:
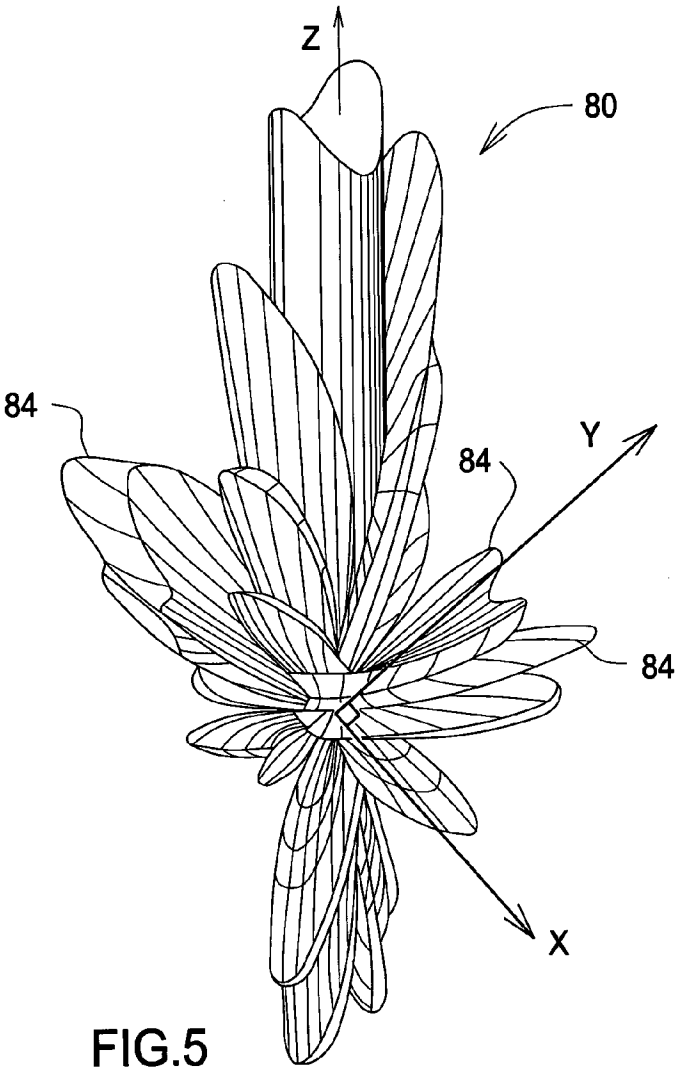
FIG. 5 is a perspective view of a three-dimensional antenna pattern representing a first antenna pattern comprising a first portion of an overall antenna pattern of the antenna of the present invention.

Turning now to FIGS. 5 and 6, antenna patterns bearing on the design of an antenna in accordance with the present invention will be described immediately hereinafter including the highly advantageous antenna pattern that results through the addition of the supplemental surface current configuration of the present invention.

To that end, FIG. 5 illustrates a three-dimensional antenna pattern 80 of a 3 μm long, 60-degree bow-tie antenna (i.e., θ=60 degrees in FIG. 1), having peripheral outline 62 of antenna 60 of FIG. 3. Accordingly, antenna pattern 80 plotted along standard x, y and z coordinate axes serves as a first antenna pattern that is to be supplemented and advantageously modified using the supplemental antenna current configuration of the present invention. Relative antenna gain is plotted based on three-dimensional angular orientation. The half of the plot above an x-y plane represents the air-side, while the half of the plot, below the x-y plane, represents the substrate-side gain. It should be appreciated that, if a conventional bow-tie antenna (not shown) were constructed having the peripheral outline of antenna 60 at the contemplated dimensions, antenna pattern 80 would be representative of the antenna pattern of such an antenna. Accordingly, antenna pattern 80 can be used for comparison purposes as demonstrating the advantages of the present invention. More importantly, however, antenna pattern 80 is useful in the present design protocol for establishing reception pattern characteristics of a supplemental configuration which most advantageously alters pattern 80, as well as contributing additional advantageous characteristics.

FIG. 6, illustrates an antenna pattern 82, in accordance with the present invention, corresponding to the antenna of FIG. 3 arising, in part, from antenna pattern 80 of FIG. 5, but including the highly advantageous effects of supplemental surface current configuration 68. For antenna pattern 80 of FIG. 5, it is observed that significant energy is present in side lobes 84 which surround the base of the antenna pattern, resulting in an overall antenna pattern that has less than optimum gain and directivity in the air-side direction. Also, although not shown in this figure, there is significant energy lost to surface waves for this antenna geometry. This energy loss contributes to poor antenna radiation efficiency. In the antenna pattern of FIG. 6, however, side lobes 86 are remarkably small and conform to an overall slim peripheral outline of the antenna pattern extending to its much increased peak value 88 having highly increased directivity. The overall peak directional reception value in the air-side direction (above the x-y plane) is approximately 8.84 dBi for the conventional antenna pattern of FIG. 5 and approximately 12.47 dBi for the enhanced antenna pattern of the present invention, as illustrated in FIG. 6. In addition, the surface waves are reduced, thus yielding higher radiation efficiency. The supplemental grating of the present invention can be thought of as providing a narrow, supplemental reception cone that can be tailored based, at least in part, on the reception pattern of the antenna that it is intended to supplement. Remarkably, reception in the air-side direction is increased in the present example by approximately 3.6 dB or 223% percent. It is important to note that this simulation did not use a ground plane (item 36 of FIG. 2) which would still further enhance air-side gain by up to another 100%, depending on the positioning of the ground plane.

Referring to FIGS. 3, 5 and 6, at this juncture, it is appropriate to note that one of ordinary skill in the art may believe that the antenna patterns provided by peripheral bowtie configuration 62 of the antenna and supplemental grating 68 (both of FIG. 3) of the present invention would simply combine in an additive manner. It has been empirically found, however, that a highly advantageous interaction is present. This remarkable interaction is particularly evidenced by the reduction in energy present in side lobes 86 (FIG. 6) of the combined antenna pattern, as compared to the markedly higher energy that is present in side lobes 84 (FIG. 5) of the baseline bowtie pattern. The overall result of this interaction being a directional reception pattern with limited side lobe energy. Moreover, while side lobe energy in the bowtie pattern is described as being "reduced", it should be appreciated that this energy is not thought of as being lost, but rather is interactively coupled to the highly enhanced surface normal gain.

Figure 7A:
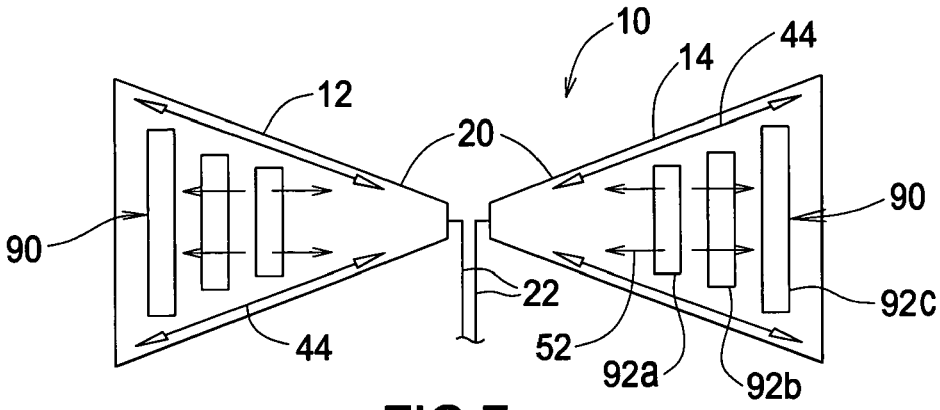
FIGS. 7A–7C are diagrammatic plan views which illustrate various alternative slot configurations formed in accordance with the present invention.
Figure 7B:
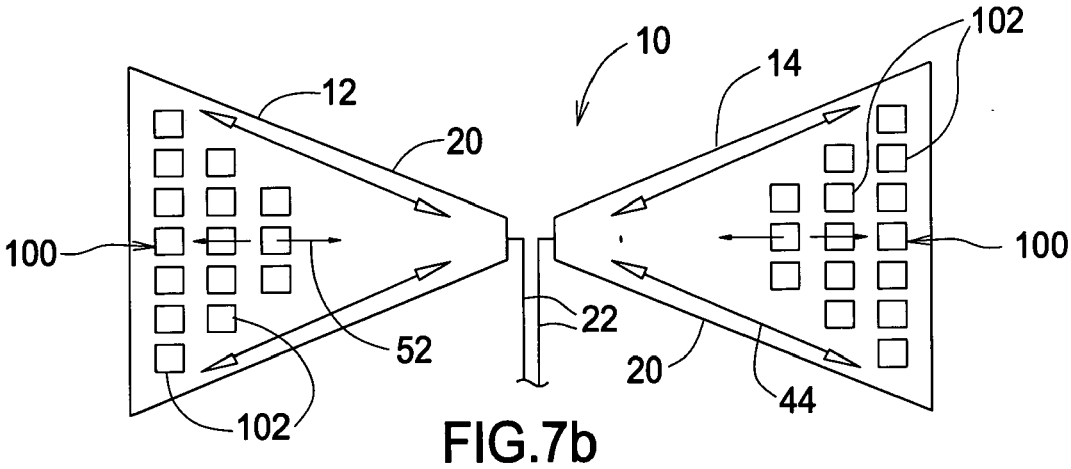
Figure 7C:
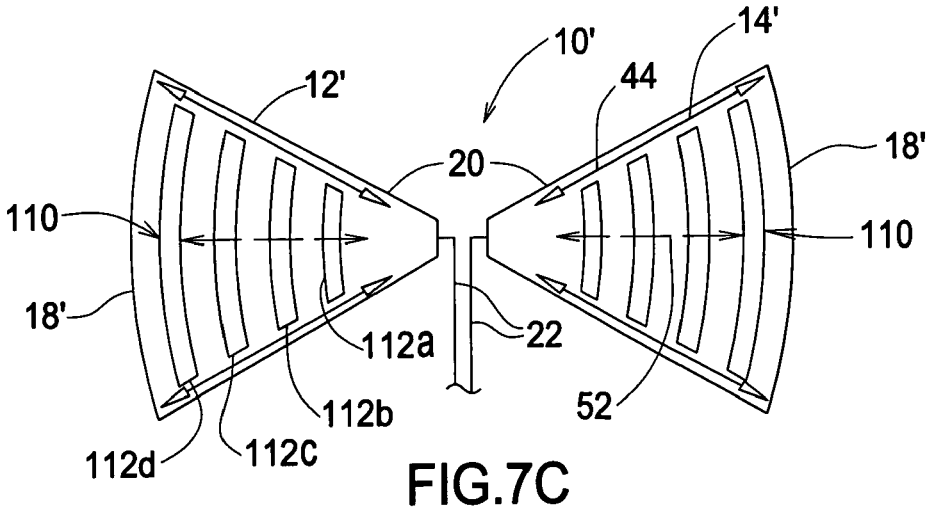

Referring generally to FIGS. 7A–7C, it should be appreciated that the supplemental surface current configuration of the present invention may take on any variety of alternative forms while still remaining within the scope of the present invention. For example, FIG. 7A illustrates antenna 10 including a first alternative supplemental surface current configuration, produced in accordance with the present invention, that is indicated by the reference number 90 having a series of spaced apart slots 92*a*–92*c* on each of bow arms 12 and 14. These slots, like all alternative configurations described herein, are produced consistent with the foregoing discussions, but include a progressively increasing elongated dimension, as distance increases from the apex of each bow arm. As can be seen in the present figure and as is consistent through all the various figures, dominant paths 44 are undisturbed from a practical standpoint.

FIG. 7B illustrates antenna 10 having a second alternative supplemental surface current configuration, produced in accordance with the present invention, and indicated by the reference numeral 100. Configuration 100 is made up of an array of square apertures, several of which are indicated by the reference number 102. In the present example, apertures 102 are arranged in three spaced apart rows that are made up of three, five and seven apertures, respectively, in a direction away from the apex of each bow arm such that the rows increase progressively in length.

FIG. 7C illustrates an antenna 10', produced in accordance with the present invention, having a third alternative supplemental surface current configuration 110. In this embodiment, bow arms 12' and 14' include a semicircular outer edge 18' which is not a requirement, but may be advantageous, for example, with regard to tailoring the antenna pattern further. Configuration 110 is made up of a spaced apart series of arcuate slots 112*a*–112*d* having a semicircular or curved configuration such that each slot progressively increases in length in a direction that is away from the apex of each bow arm.

Figure 8:
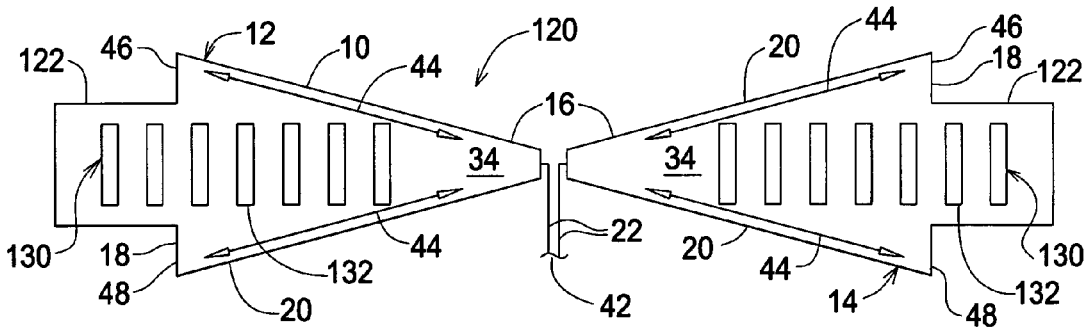
FIG. 8 is a diagrammatic plan view of an antenna, produced in accordance with the present invention, including an extension configuration for forming the supplemental antenna current configuration of the present invention.

Turning now to FIG. 8, attention is directed to still another alternative form of the supplemental surface current configuration of the present invention. Specifically, an alternative configuration of a planar antenna, produced in accordance with the present invention, is generally indicated by the reference number 120. To the extent that antenna 120 resembles previously described antenna 10, for example, with respect to its layered structure and the nature of its dominant surface current paths, such descriptions are not repeated for purposes of brevity. Antenna 120 is unlike previously described antenna 10, however, with respect to its overall peripheral outline, which includes an extension 122 centered along each outermost edge 18 of each bow arm. It should be recognized, in view of the discussions above, that each extension 122 is isolated from surface currents in dominant paths 44 by virtue of being arranged between projections of the dominant paths as well as being positioned outward of edges 18 which continue to serve as reflectors 46 and 48.

With continuing reference to FIG. 8, extensions 122 are highly advantageous in providing additional surface area on which to extend the supplemental surface current configuration of the present invention. In the present example, a supplemental surface current configuration 130 is formed as an extended array of seven spaced apart slots, several of which are individually indicated by the reference number 132. Accordingly, the extended slot array may further contribute to an overall antenna pattern which may be used, for example, to even further enhance air-side gain and directivity. It is to be understood that extensions 122 may be used for the purpose of extending any slot pattern described above. Further, the slot pattern on the extensions may include a geometric pattern that is different from the slot pattern formed inwardly therefrom; that is, toward the apex of each of the bow arms. Moreover, each extension 122 may include any suitable dimensional configuration (i.e., length and width).

Figure 9:
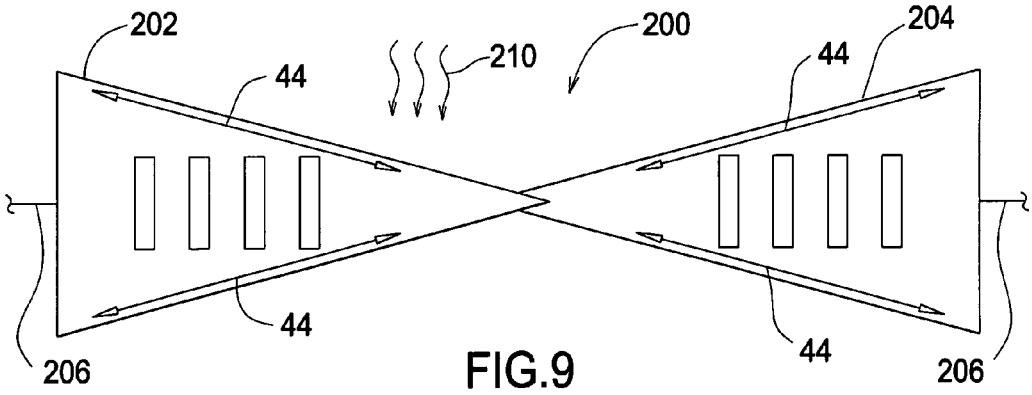
FIG. 9 is a diagrammatic plan view of another antenna, produced in accordance with the present invention, having a supplemental antenna current configuration in an overall device integrated configuration.

A further alternative implementation, produced in accordance with the present invention, is illustrated in FIG. 9 in which a device integrated planar antenna is generally indicated by the reference number 200. Device integrated antenna 200 includes an active device (not visible in the current view) that is positioned or sandwiched between confronting surface areas of bow arms 202 and 204 proximate to the apex regions of the bow arms. This configuration is described in detail in the above incorporated '935 application. Suitable devices may be used including, but not limited to diode types such as MIM, MIIM, SIS and Schottky, and devices such as microbolometers and Josephson junctions in applications including high-speed detection, mixing and modulation of optical communication signals, emission of optical radiation, millimeter wave and submillimeter wave detection for thermal imaging, as well as emission of electromagnetic energy. Moreover, as is further described in the above incorporated application, an edge fed configuration may be utilized wherein opposing low frequency signal leads 206 are connected to opposing, outermost edges 208 of each bow arm. In this regard, the device integrated antenna supports a low frequency signal that is not confined to dominant paths 44. Hence, this low frequency signal, which can be either an input or an output, is isolated from high frequency currents which flow in the dominant paths by virtue of positioning of ports corresponding to leads 206. The high frequency currents can be produced, for example, by an emitter device at the bow-tie apex or produced responsive to an incident electromagnetic radiation 210.

Irrespective of the configuration of the device integrated antenna, insofar as its input/output configuration, the highly advantageous supplemental surface current configuration 50 of the present invention may be used in a manner that is consistent with the foregoing descriptions to tailor the antenna response pattern of device integrated antenna 200 in a way which provides heretofore unseen advantages, for example, with regard to enhanced air-side gain.

As may be appreciated by comparing FIGS. 5 and 6, the present invention provides the advantages of a bow-tie antenna configuration and an optical grating, at the contemplated wavelengths, in a way which serves to combine the advantageous reception properties of each. In particular, an optical grating can be designed to add a narrow reception cone in the air-side direction while interactively coupling side lobe energy to the surface normal direction. A substrate supported bow-tie antenna of equal length, in contrast, has lower air-side gain and also receives energy at a given tilt angle to a surface normal direction due to its prominent side lobes. The present invention advantageously complements the narrow reception cone of an optical grating with the characteristic bow-tie reception pattern to achieve a wide reception cone while affording high, maximum directivity in the surface normal air-side direction. Stated in a slightly different way, the opposing antenna arms can be thought of as initially or independently producing a first antenna pattern having a main lobe that is centered in a direction that is at least generally normal to the planar opposing antenna arms while also producing an arrangement of side lobes of a given energy. The supplemental antenna current configuration of the present invention is formed in the current isolated area of both antenna arms such that a modified antenna pattern is produced in cooperation with the opposing antenna arms in a way which transfers at least a portion of the given energy of the side lobe arrangement to a modified main lobe of the modified antenna pattern.

It is noted that the present invention contemplates the use of relatively small antenna structures at optical wavelengths. For example, an optical wavelength antenna may have overall dimensions of approximately 3 μm by 2 μm. For an incident electromagnetic radiation, the source can be, for example, light input through an optical fiber or a focused optical beam. A suitable antenna should have large, air-side gain to maximize power reception as well as a broad and even beamwidth to withstand fabrication and alignment tolerances. As noted earlier, gain is mathematically defined as the product of air-side directivity and radiation efficiency. For bow-tie antennas on dielectrics, the air-side directivity increases for certain resonant lengths of the antenna. While a small (i.e., sub-half-wavelength) prior art bow-tie antenna has a relatively broad beamwidth, the air-side directivity, particularly in directions at least generally perpendicular to the plane of the antenna, is small. In this regard, prior art bow-tie antennas exhibit significant energy coupled into surface wave modes, when formed on a substrate, as described above. A larger, half or full-wave bow-tie antenna has a broader beamwidth and moderate air-side directivity. For even longer antennas, it is possible to further increase the air-side directivity. One of ordinary skill in the art may, at first blush, suggest simply enlarging the antenna to increase the reception from the air-side direction. This solution is problematic, in and of itself, since it is accompanied by undesirable changes in the antenna reception pattern, including enhanced preferential reception from directions tilted away from the direction normal to the surface and more energy coupled into surface waves. These undesirable changes lead to an overall reduction in the antenna radiation efficiency. Therefore, although larger antennas on dielectric substrates exhibit increased air-side directivity, the efficiency of such larger antennas is decreased, resulting in reduced overall air-side gain.

However, it should particularly be noted that there may be situations where a small antenna is desired for its higher radiation efficiency but fabrication limitations do not allow for its proper construction. For example, electron beam lithography may be used to fabricate a 0.5 μm antenna, but the resulting antenna shape will be distorted with, for instance, rounded edges due to limitations in the achievable fabrication precision using this method with the current state of technology. The distortion in antenna shape leads to degradation in the antenna performance. Therefore, although a larger antenna may exhibit lower radiation efficiency, as previously discussed, it may be desirable to use a larger antenna rather than a smaller one because a larger antenna is easier to build with greater accuracy with current fabrication techniques. In other words, although one might design an ideal, small antenna for a particular purpose and desired gain profile, a larger antenna may actually yield better results in reality since distortions in such a small antenna due to fabrication shortcomings may negate any theoretical performance advantages.

Turning briefly to a discussion of the prior art, it is submitted that the present invention is unlike the prior art at least for the recognition that it is highly advantageous to avoid disturbing current flow in dominant paths that are inherent to a particular antenna configuration. In contrast, as an example, Lestari deliberately disrupts such current flow in order to achieve its described advantages, thereby teaching directly away from the present invention. Moreover, prior art toothed bowtie antennas are similarly configured in a way which deliberately disrupts the dominant paths.

Inasmuch as the arrangements and associated methods disclosed herein may be provided in a variety of different configurations and modified in an unlimited number of different ways, it should be understood that the present invention may be embodied in many other specific forms without departing from the spirit or scope of the invention. For example, although each of the aforedescribed embodiments have been illustrated with various components having particular respective orientations, it should be understood that the present invention may take on a variety of specific configurations with the various components being located in a wide variety of positions and mutual orientations and still remain within the spirit and scope of the present invention. Furthermore, suitable equivalents may be used in place of or in addition to the various claim elements, the function and use of such substitute or additional equivalents being held to be familiar to those skilled in the art and are, therefore, regarded as falling within the scope of the present invention. Therefore, the present examples are to be considered as illustrative and not restrictive, and the invention is not to be limited to the details given herein, but may be modified within the scope of the appended claims.

What is claimed is:

1. An antenna arrangement comprising:

a pair of at least generally planar opposing antenna arms, each of which supports a first high frequency antenna current that is produced responsive to an input and each of which includes a peripheral outline for confining the first high frequency current to a pair of first and second dominant paths, that are defined by the peripheral outline, in a spaced apart relationship across each of the opposing antenna arms so as to define an area therebetween which is isolated, at least to an approximation, from the first and second dominant paths; and a configuration located in said area between the first and second dominant paths of at least one of the antenna arms for producing an additional high frequency current responsive to the input which additional high frequency current cooperates with the first high frequency antenna current to produce an overall antenna response, wherein said configuration includes a grating in said area that is isolated from the dominant paths for producing the additional high frequency current.

2. The antenna arrangement of claim 1 wherein said input is an electromagnetic wave that is incident upon the opposing antenna arms.

3. The antenna arrangement of claim 1 wherein said input is an electrical drive signal that is coupled to said opposing antenna arms.

4. The antenna arrangement of claim 1 wherein said opposing antenna arms are bow arms which cooperate to define an overall bow-tie configuration as said peripheral outline.

5. The antenna arrangement of claim 1 wherein said opposing antenna arms independently produce a first antenna pattern including a given gain in a direction that is at least generally normal to the planar opposing antenna arms and wherein said configuration is formed in said area of both antenna arms such that a modified gain in the normal direction is greater than said given gain.

6. The antenna arrangement of claim 1 wherein said overall gain is at least 100% greater than said given gain.

7. The antenna arrangement of claim 1 wherein said opposing antenna arms independently produce a first antenna pattern having a main lobe that is centered in a direction that is at least generally normal to the planar opposing antenna arms and an arrangement of side lobes of a given energy and wherein said configuration is formed in said area of both antenna arms such that a modified antenna pattern is produced by said configuration in cooperation with the opposing antenna arms in a way which transfers at least a portion of said given energy of side lobe arrangement to a modified main lobe of said modified antenna pattern.

8. The antenna arrangement of claim 1 wherein said grating is formed on each one of said antenna arms.

9. The antenna arrangement of claim 1 wherein each of said antenna arms includes a generally planar substrate that supports a generally planar electrically conductive layer for conducting said first high frequency antenna current and said grating includes an arrangement of apertures that extend at least through a thickness of said electrically conductive layer.

10. The antenna arrangement of claim 1 wherein each of said antenna arms includes a generally planar substrate having a thickness and said substrate supports a generally planar electrically conductive layer for conducting said first high frequency antenna current and said grating is defined using an arrangement of slots, each of which is inset in said thickness such that the arrangement of slots cooperates with the electrically conductive layer in a way which forms said grating.

11. The antenna arrangement of claim 10 wherein each of said slots is formed using at least one closed peripheral sidewall defined by the substrate.

12. The antenna arrangement of claim 11 wherein said grating is formed by applying said electrically conductive layer at least generally conformally across each of said slots.

13. The antenna arrangement of claim 1 wherein said antenna arms cooperate to define an elongation axis of the antenna arrangement and wherein each of said antenna arms includes an electrically conductive layer supported by a substrate for conducting said first high frequency antenna current and said grating includes an arrangement of at least one slot defined, at least in part, using the electrically conductive layer and which slot includes an elongated dimension that is arranged transverse to said elongation axis of the antenna arrangement.

14. The antenna arrangement of claim 13 wherein the elongated dimension of said slot is at least approximately perpendicular to the elongation axis of the antenna arrangement.

15. The antenna arrangement of claim 14 wherein said arrangement of slots includes one or more additional slots each of which is defined, at least in part, using the electrically conductive layer such that the elongated dimension of each slot within the arrangement of slots is at least approximately perpendicular to the elongation axis of the antenna arrangement.

16. In producing an antenna arrangement, a method comprising:

arranging a pair of at least generally planar opposing antenna arms such that each supports a first high frequency antenna current responsive to an input and each includes a peripheral outline for confining the first high frequency current to a pair of first and second dominant paths, that are defined by the peripheral outline, in a spaced apart relationship across each of the opposing antenna arms so as to define an area therebetween which is isolated, at least to an approximation, from the first and second dominant paths; and locating a configuration in said area between the first and second dominant paths of at least one of the antenna arms for producing an additional high frequency current responsive to the input for cooperating with the first high frequency antenna current to produce an overall antenna response, wherein locating said configuration includes forming a grating as part of said configuration in said area that is isolated from the dominant paths for producing the additional high frequency current.

17. The method of claim 16 including receiving an electromagnetic wave that is incident upon the opposing antenna arms as said input.

18. The method of claim 16 including coupling an electrical drive to said opposing antenna arms as said input.

19. The method of claim 16 wherein arranging the opposing antenna arms includes forming the antenna arms as bow arms which cooperate to define an overall bow-tie configuration as said peripheral outline.

20. The method of claim 19 wherein said opposing antenna arms are arranged to independently produce a first antenna pattern including a given gain in a direction that is at least generally normal to the planar opposing antenna arms and wherein said arranging the opposing antenna arms further includes forming said configuration in said area of both antenna arms in a way which produces a modified antenna pattern such that an overall gain of the modified antenna pattern in the normal direction is greater than said given.

21. The method of claim 20 wherein said overall gain is at least 100% greater than said given gain.

22. The method of claim 16 wherein said opposing antenna arms independently produce a first antenna pattern having a main lobe that is centered in a direction that is at least generally normal to the planar opposing antenna arms and an arrangement of side lobes of a given energy and wherein said configuration is formed in said area of both antenna arms such that a modified antenna pattern is produced by said configuration in cooperation with the opposing antenna arms in a way which transfers at least a portion of said given energy of said side lobe arrangement to a modified main lobe of said modified antenna pattern.

23. The method of claim 16 wherein said grating is formed on each one of said antenna arms.

24. The method of claim 16 wherein the arranging the antenna arms includes forming each antenna arm to include a generally planar substrate that supports an electrically conductive layer for conducting said high frequency antenna current and forming said grating includes defining an arrangement of apertures that extend at least through said electrically conductive layer.

25. The method of claim 24 wherein each of said antenna arms includes a generally planar substrate having a thickness and said substrate supports a generally planar electrically conductive layer for conducting said first high frequency antenna current and said method further comprising forming an arrangement of slots that are inset in said thickness of said substrate such that the arrangement of slots cooperates with the electrically conductive layer in a way which forms said grating.

26. The method of claim 25 further comprising defining each slot of said arrangement of slots using a closed peripheral sidewall that is formed in the thickness of said substrate.

27. The method of claim 25 including conformally applying said electrically conductive layer across each of said slots.

28. The method of claim 16 wherein arranging said antenna arms causes the antenna arms to cooperate to define an elongation axis of the antenna arrangement and so that each of the antenna arms includes an electrically conductive layer for conducting said first high frequency antenna current and said grating is formed including an arrangement of at least one slot which includes an elongated dimension that is arranged transverse to said elongation axis of the antenna arrangement.

29. The method of claim 28 further comprising positioning the elongated dimension of said slot at least approximately perpendicular to the elongation axis of the antenna arrangement.

30. The method of claim 29 wherein said arrangement of slots is formed to include one or more additional slots such that the elongated dimension of each slot within the arrangement of slots is at least approximately perpendicular the elongation axis of the antenna arrangement.

31. An antenna arrangement comprising:

a pair of at least generally planar opposing antenna arms, each of which supports a first high frequency antenna current that is produced responsive to an input and which is confined to an arrangement of dominant paths that is defined by each of the opposing antenna arms so as to produce a first antenna pattern such that said arrangement of dominate paths defines, between individual ones of the dominant paths, an area of said substrate which, at least to an approximation, does not support said first high frequency current; and a configuration in said area of at least one of said antenna arms for modifying said first antenna pattern in a way which produces a modified antenna pattern responsive to the input, and wherein said configuration includes a grating that is isolated from the arrangement of dominant paths for producing an additional high frequency antenna current responsive to said second antenna pattern.

32. The antenna arrangement of claim 31 wherein said input is an electromagnetic wave that is incident upon the opposing antenna arms.

33. The antenna arrangement of claim 31 wherein said input is an electrical drive signal that is coupled to said opposing antenna arms.

34. The antenna arrangement of claim 31 wherein said opposing antenna arms are bow arms which cooperate to define an overall bow-tie configuration as a peripheral outline such that said first antenna pattern is a characteristic bow-tie antenna pattern.

35. The antenna arrangement of claim 31 wherein said opposing antenna arms independently produce said first antenna pattern including a given gain in a direction that is at least generally normal to the planar opposing antenna arms and wherein said configuration is formed in said area of both antenna arms in a way which produces a modified antenna pattern such that an overall gain in the normal direction is greater than said given gain.

36. The antenna arrangement of claim 31 wherein said overall gain is at least 100% greater than said given gain.

37. The antenna arrangement of claim 31 wherein said opposing antenna arms independently produce a first antenna pattern having a main lobe that is centered in a direction that is at least generally normal to the planar opposing antenna arms and an arrangement of side lobes of a given energy and wherein said configuration is formed in said area of both antenna arms such that a modified antenna pattern is produced by said configuration in cooperation with the opposing antenna arms in a way which transfers at least a portion of said given energy of said side lobe arrangement to a modified main lobe of said modified antenna pattern.

38. The antenna arrangement of claim 31 wherein said grating is formed on each one of said antenna arms.

39. The antenna arrangement of claim 31 wherein each of said antenna arms includes a generally planar substrate that supports a generally planar electrically conductive layer for conducting said first high frequency antenna current and said grating includes an arrangement of apertures that extend at least through a thickness of said electrically conductive layer.

40. The antenna arrangement of claim 31 wherein each of said antenna arms includes a generally planar substrate having a thickness and said substrate supports a generally planar electrically conductive layer for conducting said first high frequency antenna current and said grating is defined using an arrangement of slots, each of which is inset in said thickness such that the arrangement of slots cooperates with the electrically conductive layer in a way which forms said grating.

41. The antenna arrangement of claim 40 wherein each of said slots is formed using at least one closed peripheral sidewall defined by the substrate.

42. The antenna arrangement of claim 41 wherein said grating is formed by applying said electrically conductive layer at least generally conformally across each of said slots.

43. The antenna arrangement of claim 31 wherein said antenna arms cooperate to define an elongation axis of the antenna arrangement and wherein each of said antenna arms includes a electrically conductive layer supported by an insulating substrate for conducting said high frequency antenna current and said configuration includes an arrangement of at least one slot defined by the electrically conductive layer which includes an elongated dimension that is arranged transverse to said elongation axis of the antenna arrangement.

44. The antenna arrangement of claim 43 wherein the elongated dimension of said slot is at least approximately perpendicular to the elongation axis of the antenna arrangement.

45. The antenna arrangement of claim 44 wherein said arrangement of at least one slots includes one or more additional slots such that the elongated dimension of each slot within the arrangement of at least one slots is at least approximately perpendicular to the elongation axis of the antenna arrangement.

46. In producing an antenna arrangement, a method comprising:

arranging a pair of at least generally planar opposing antenna arms such that each supports a first high frequency antenna current that is produced responsive to an input and the first high frequency antenna current is confined to an arrangement of dominant paths that is defined by each of the opposing antenna arms so as to produce a first antenna pattern such that said arrangement of dominate paths defines, between individual ones of the dominant paths, an area of said substrate which, at least to an approximation, does not support said first high frequency current; and forming a configuration in said area of at least one of said antenna arms for modifying said first antenna pattern in a way which produces a modified antenna pattern responsive to the input, wherein forming said configuration includes forming a grating as part of said configuration in said area that is isolated from the dominant paths for producing the second high frequency current.

47. The method of claim 46 including receiving an electromagnetic wave that is incident upon the opposing antenna arms as said input.

48. The method of claim 46 including coupling an electrical drive to said opposing antenna arms as said input.

49. The method of claim 46 wherein arranging the opposing antenna arms includes forming the antenna arms as bow arms which cooperate to define an overall bow-tie configuration as said peripheral outline.

50. The method of claim 49 wherein said opposing antenna arms are arranged to produce said first antenna pattern including a given gain in a direction that is at least generally normal to the planar opposing antenna arms and including forming said configuration in said area of both antenna arms in a way which produces a modified antenna pattern such that an overall gain in the normal direction is greater than said given gain.

51. The method of claim 50 wherein said overall gain is at least 100% greater than said given gain.

52. The antenna arrangement of claim 46 wherein said opposing antenna arms produce a first antenna pattern having a main lobe that is centered in a direction that is at least generally normal to the planar opposing antenna arms and an arrangement of side lobes of a given energy and wherein said configuration is formed in said area of both antenna arms such that a modified antenna pattern is produced by said configuration in cooperation with the opposing antenna arms in a way which transfers at least a portion of said given energy of said side lobe arrangement to a modified main lobe of said modified antenna pattern.

53. The method of claim 46 wherein said grating is formed on each one of said antenna arms.

54. The method of claim 53 wherein arranging the antenna arms includes forming each antenna arm to include a generally planar substrate that supports an electrically conductive layer for conducting said high frequency antenna current and forming said grating includes defining an arrangement of apertures that extend at least through said electrically conductive layer.

55. The method of claim 54 wherein each of said antenna arms includes a generally planar substrate having a thickness and said substrate supports a generally planar electrically conductive layer for conducting said first high frequency antenna current and said method further comprising forming an arrangement of slots that are inset in said thickness of said substrate such that the arrangement of slots cooperates with the electrically conductive layer in a way which forms said grating.

56. The method of claim 55 including defining each slot of said arrangement of slots using a closed peripheral sidewall that is formed in the thickness of said substrate.

57. The method of claim 55 including conformally applying said electrically conductive layer across each of said slots.

58. The method of claim 46 wherein arranging said antenna arms causes the antenna arms to cooperate to define an elongation axis of the antenna arrangement and so that each of the antenna arms includes a coextensive electrically conductive layer supported by an insulating substrate for conducting said first high frequency antenna current and said grating is formed including an arrangement of at least one slot which includes an elongated dimension that is arranged transverse to said elongation axis of the antenna arrangement.

59. The method of claim 58 including positioning the elongated dimension of said slot at least approximately perpendicular to the elongation axis of the antenna arrangement.

60. The method of claim 59 wherein said arrangement of at least one slots is formed to include one or more additional slots such that the elongated dimension of each slot within the arrangement of at least one slots is at least approximately perpendicular the elongation axis of the antenna arrangement.

61. An antenna arrangement, comprising:

at least one substrate having a planar configuration and a substrate thickness between a pair of opposing major surfaces thereof;

an electrically conductive ground plane layer supported on a first one of said major surfaces;

a dielectric layer directly supported by said electrically conductive ground plane layer opposite said substrate; and a patterned electrically conductive layer supported directly by said dielectric layer, opposite said electrically conductive ground plane layer, for providing an antenna pattern, wherein said substrate thickness is characterized by a substrate thickness tolerance and said dielectric layer includes a dielectric layer thickness that is characterized by a dielectric layer thickness tolerance such that said dielectric layer thickness tolerance is greater than said substrate thickness tolerance.

62. The antenna arrangement of claim 61 wherein said ground plane layer is in direct contact with the first major surface of said substrate.

63. The antenna arrangement of claim 61 including at least two at least generally planar substrates arranged as opposing antenna arms, each of which supports a first high frequency antenna current, using said patterned electrically conductive layer, responsive to an input and each of which includes a peripheral outline for confining the first high frequency current to a pair of first and second dominant paths, that are defined by the peripheral outline, in a spaced apart relationship across each of the opposing antenna arms so as to define an area therebetween which is isolated, at least to an approximation, from the first and second dominant paths.

64. The antenna arrangement of claim 63 further comprising a configuration located in said area between the first and second dominant paths of at least one of the antenna arms for producing an additional high frequency antenna current responsive to the input which additional high frequency antenna current cooperates with the first high frequency antenna current to produce said antenna pattern.

65. The antenna arrangement of claim 63 wherein said opposing antenna arms are bow arms which cooperate to define an overall bow-tie configuration as said peripheral outline.

66. The antenna arrangement of claim 63 wherein said opposing antenna arms independently produce a first antenna pattern including a given gain in a direction that is at least generally normal to the planar opposing antenna arms and wherein said configuration is formed in said area of both antenna arms such that a modified gain in the normal direction is greater than said given gain.

67. In producing an antenna arrangement, a method comprising:

providing at least one substrate having a planar configuration and a substrate thickness between a pair of opposing major surfaces thereof;

supporting an electrically conductive ground plane layer on a first one of said major surfaces;

forming a dielectric layer directly supported by said electrically conductive ground plane layer opposite said substrate; and arranging a patterned electrically conductive layer supported directly by said dielectric layer, opposite said electrically conductive ground plane layer, for providing an antenna reception pattern, wherein said substrate thickness is characterized by a substrate thickness tolerance and wherein forming said dielectric layer forms the dielectric layer having a dielectric layer thickness tolerance such that said dielectric layer thickness tolerance is greater than said substrate thickness tolerance.

68. The method of claim 67 wherein said ground plane layer is supported in direct contact with the first major surface of said substrate.

69. The method of claim 67 wherein substrate providing includes providing at least two at least generally planar substrates arranged as opposing antenna arms, each of which supports a first high frequency antenna current, using said patterned electrically conductive layer, responsive to an input and said method further comprising forming each antenna arm to include a peripheral outline for confining the first high frequency current to a pair of first and second dominant paths, that are defined by the peripheral outline, in a spaced apart relationship across each of the opposing antenna arms so as to define an area therebetween which is isolated, at least to an approximation, from the first and second dominant paths.

70. The method of claim 69 further comprising:

locating a configuration in said area between the first and second dominant paths of at least one of the antenna arms for producing an additional high frequency antenna current responsive to the input which additional high frequency antenna current cooperates with the first high frequency antenna current to produce an overall antenna response.

71. The method of claim 69 wherein said opposing antenna arms are formed as bow arms which cooperate to define an overall bow-tie configuration as said peripheral outline.

72. The method of claim 69 wherein said opposing antenna arms independently produce a first antenna pattern including a given gain in a direction that is at least generally normal to the planar opposing antenna arms and said configuration is located in said area of both antenna arms such that a modified gain in the normal direction is greater than said given gain.

* * * * *